United States Patent [19]

Shimada et al.

[11] Patent Number: 4,718,396

[45] Date of Patent: Jan. 12, 1988

[54] MULTICYLINDER INTERNAL COMBUSTION ENGINE WITH ROTATION SENSOR

[75] Inventors: Shinichi Shimada; Kazuo Otsuka, both of Saitama, Japan

[73] Assignee: Honda Giken Kogyo Kabushiki Kaisha, Tokyo, Japan

[21] Appl. No.: 922,994

[22] Filed: Oct. 24, 1986

[30] Foreign Application Priority Data

Oct. 21, 1985 [JP] Japan ..... 60-235046
Oct. 21, 1985 [JP] Japan ..... 60-235047

[51] Int. Cl.[4] ..... F02P 7/067

[52] U.S. Cl. ..... 123/617; 123/476; 73/117.3

[58] Field of Search ..... 73/117.3; 123/90.27, 123/414, 476, 612, 617

[56] References Cited

U.S. PATENT DOCUMENTS 4,365,602 12/1982 Stiller et al. ..... 123/414
4,519,362 5/1985 Arakawa et al. ..... 123/414

*Primary Examiner*—Stephen F. Husar
*Attorney, Agent, or Firm*—Lyon & Lyon

[57] ABSTRACT

A multicylinder internal combustion engine includes a pair of camshafts, a pair of driven pulleys fixed to ends of the camshafts, a crankshaft, a driver pulley fixed to an end of the crankshaft, and a single endless belt trained around the driven pulleys and the driver pulley. A rotation sensor for detecting the rotation of the engine is disposed between a fixed engine member and the one of the driven pulleys around which a portion of the endless belt subject to greater tension is trained. A distributor is coupled coaxially to an opposite end of the camshaft to which said one driven pulley is fixed.

18 Claims, 6 Drawing Figures

MULTICYLINDER INTERNAL COMBUSTION ENGINE WITH ROTATION SENSOR

BACKGROUND OF THE INVENTION

The present invention relates to a multicylinder internal combustion engine, and more particularly to a multicylinder internal combustion engine with a rotation sensor and distributor.

Recent years have seen the rapid development of electronic controls of automotive engines. Where an engine having a fuel injection device is controlled by an electronic controller, the electronic controller is required to be supplied with various items of information related to engine rotation such as the top-dead-center positions of engine pistons and the identification of cylinders into which fuel is to be injected, in order to control the amount of fuel to be injected, the timing of fuel injection, and the ignition timing with high accuracy. These information signals have heretofore been generated by an electromagnetic sensor mounted on a crankshaft or a shaft rotatable in timed relation to the crankshaft.

The engine has a distributor for distributing high-voltage surges respectively to spark plugs. The distributor is generally coupled directly to the crankshaft or via a gear to the crankshaft. The distributor is apt to malfunction due to mechanical hysteresis or wear, and hence may cause a problem in high accurate engine control.

In those engines which have a plurality of camshafts, such as a V-shaped engine and a DOHC engine, the camshafts are driven by a crankshaft through a single endless belt and pulleys mounted on the camshafts and the crankshaft. The endless belt on the pulleys on the camshafts is subjected to different tensions, i.e., larger and smaller tensions, which act on the respective camshafts as a result of the direction in which the crankshaft is rotated.

The difference between these varying tensions on the camshaft pulleys has no appreciable effect on the mechanism operation of intake and exhaust valves. However, where the belt stretch between the camshafts is relatively large as in a V-shaped engine, the difference between the varying tensions on the camshafts adversely affects the response of an electric signal generated by a sensor. Therefore, control accuracy may not be good enough if the engine control sensor or distributor is positioned in a certain location.

In the event that the rotation sensor and distributor are mounted on one end of one rotatable shaft, the engine tends to be elongated or to be in physical interference with other accessories.

Furthermore, the electromagnetic rotation sensor is normally coupled to an end of the crankshaft or assembled in the distributor inasmuch as the sensor essentially serves to detect the rotation of the crankshaft. This arrangement has however led to an increased engine length or a complex structure, resulting in a high cost of manufacture.

The inventors have found that in a V-shaped engine having a pair of cylinder banks inclined in a V configuration, the end faces of cylinder heads in the direction of cylinder arrays are offset from each other since connecting rods extend from a crankshaft into the cylinder banks, which provides additional space at one end of a cylinder head for the rotation sensing components without lengthening the engine.

SUMMARY OF THE INVENTION

It is an object of the present invention to provide a multicylinder internal combustion engine having a rotation sensor and distributor which is so positioned as to effect engine control with higher accuracy without involving a relative increase in the engine dimensions.

Another object of the present invention is to provide a rotation sensor which simplifies the structure of an internal combustion engine associated therewith without involving a relative increase in the engine dimensions.

According to the present invention, there is provided a multicylinder internal combustion engine comprising a pair of camshafts, a pair of driven pulleys fixed to ends of the camshafts, a crankshaft, a driver pulley fixed to an end of the crankshaft, a single endless belt trained around the driven pulleys and the driver pulley, and a rotation sensor for detecting the rotation of the engine, the rotation sensor being disposed between a fixed engine member and one of the driven pulleys around which a portion of the endless belt subject to greater tension is trained. A distributor is coupled coaxially to an opposite end of the camshaft to which said one driven pulley is fixed. With the rotation sensor and/or the distributor being attached to the camshaft which undergoes greater belt tension, any adverse effect on engine rotation control due to mechanical backlash or out-of-phase condition resulting from belt elongation can be avoided. Furthermore, since the rotation sensor is disposed in a clearance produced by the inherent configuration of a V-shaped engine, any unwanted increase in the length of the engine is prevented.

According to the present invention, there is also provided a rotation sensor in a multicylinder internal combustion engine including a camshaft, a driven pulley fixed to an end of the camshaft, a crankshaft, a driver pulley fixed to an end of the crankshaft, a single endless belt trained around the driven and driver pulleys, the rotation sensor comprising a magnetic tooth disposed on the one driven pulley and an electromagnetic probe mounted on the fixed engine member for detecting when the magnetic tooth is moved in proximity with the electromagnetic probe. The driven pulley fixed to the camshaft serves as a portion of the rotation sensor, thereby reducing a sensor installation space and the number of components of the sensor.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
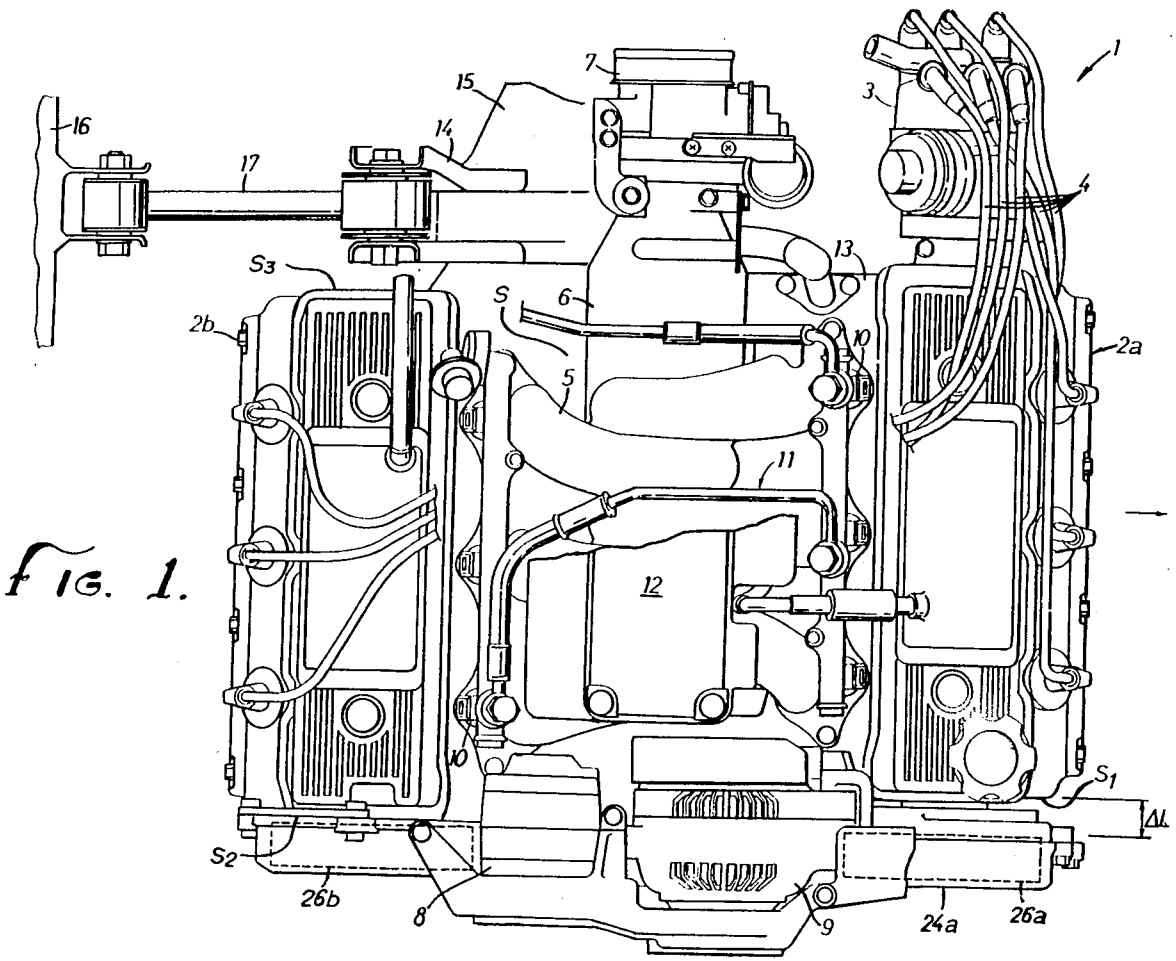
FIG. 1 is a plan view of a V-shaped 6-cylinder internal combustion engine according to the present invention.

FIG. 1 shows a V6 internal combustion engine 1 in a motor vehicle such as an automobile, the engine 1 having a pair of inclined cylinder banks 2a, 2b each having an array of three cylinders.

A distributor 3 is attached to one end of the cylinder bank 2a and coupled coaxially to a camshaft to which there is fixed a timing pulley (described later) driven by a timing belt portion subjected to a larger tension. The distributor 3 is electrically connected by plug cords 4 to spark plugs threaded in the cylinder heads of the cylinder banks for applying high-voltage surges to the spark plugs.

Centrally in a V-shaped space S defined between the cylinder banks 2a, 2b, there are disposed an intake manifold 5 and an intake chamber 6 for distributing intake air into the intake manifold 5, the intake manifold 5 being disposed upwardly of the intake chamber 6 in the vertical direction of the engine 1. A throttle body 7 with a throttle valve housed therein for controlling the amount of air drawn into the intake chamber 6 is disposed at one end (upper end in FIG. 1) of the intake chamber 6. An oil pump 8 for supplying oil to a power steering system and a battery charging generator 9 are disposed in juxtaposed relation in the other end (lower end in FIG. 1) of the V-shaped spaced S between the cylinder banks 2a, 2b. The oil pump 8 and the generator 9 can be driven by a belt and pulleys (described below).

The intake manifold 5 is joined to the cylinder banks 2a, 2b at junctions incorporating fuel injection valves 10 associated with respective cylinders. The fuel injection valves 10 are supplied with fuel by fuel distribution pipes 11 and controlled for optimum fuel injection timing by a signal from a controller 12 disposed above the intake manifold 5.

Connecting rods (not shown) extend from a crankshaft 21 (FIG. 2) and are connected to pistons slidably disposed in the cylinders in the cylinder banks 2a, 2b. The cylinder banks 2a, 2b have end surfaces $S_1$, $S_2$ (lower end in FIG. 1), respectively, in the direction of the cylinder arrays, the end surfaces $S_1$, $S_2$ being offset from each other by a dimension $\Delta L$. As viewed in FIG. 1, the upper end surface S3 of the lefthand cylinder bank 2b is displaced downwardly into a cylinder block 13, and the lower end surface $S_1$ of the righthand cylinder bank 2a is displaced upwardly into the cylinder block 13.

A bracket 14 extends from a clutch housing 15 in confronting relation to the upper end surface S3 of the lefthand cylinder bank 2b. The bracket 14 and a dashboard 16 are connected to each other by a torque rod 17 extending longitudinally of the motor vehicle and lying in a horizontal plane in which the camshafts lie. The torque rod 17 serves to bear a reactive force from the engine 1 as it is driven.

Figure 2:
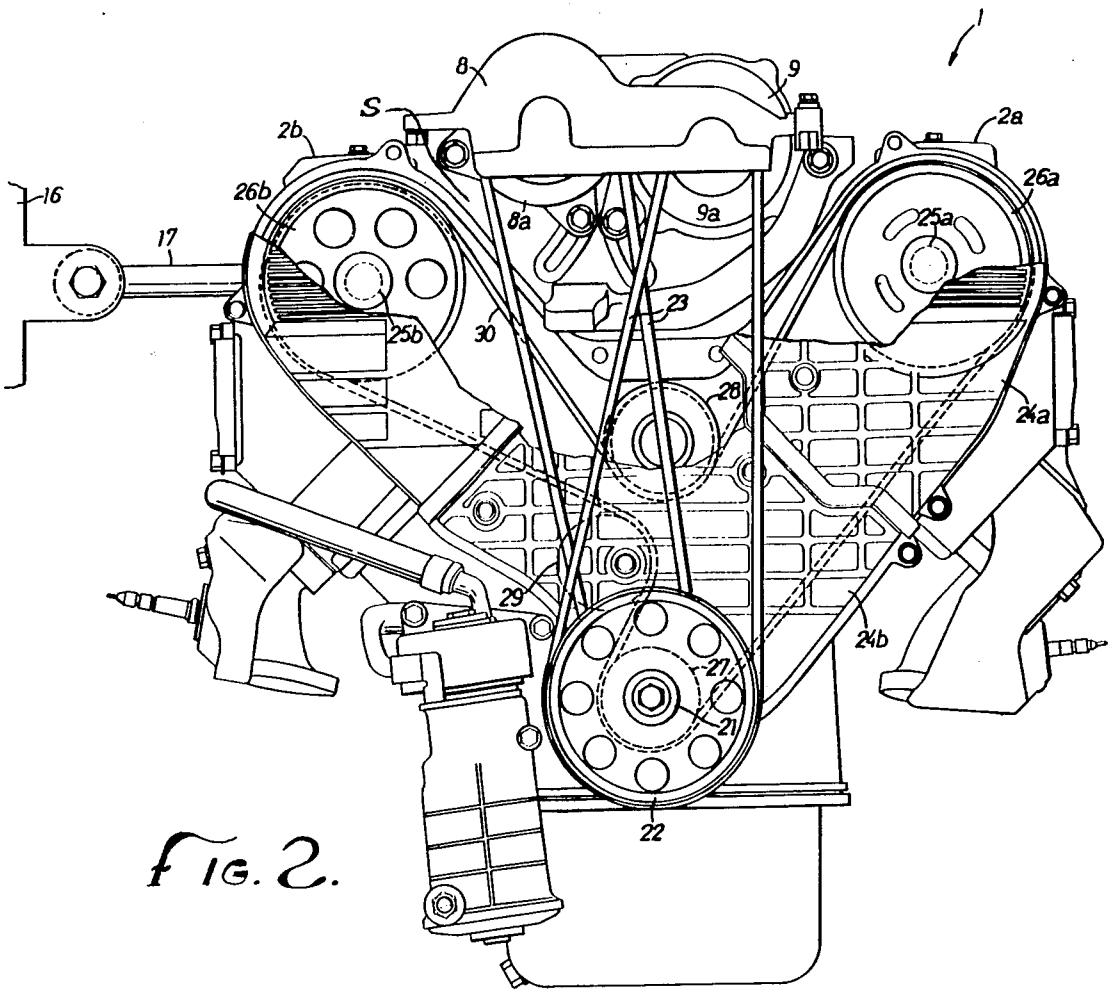
FIG. 2 is a side elevational view of the engine shown in FIG. 1.

As illustrated in FIG. 2, the crankshaft 21 has a shaft end projecting from an end surface of the engine 1, and a pulley 22 having a plurality of V-shaped belt grooves is secured to the projecting end of the crankshaft 21. The oil pump 8 and the generator 9 are driven by the crankshaft 21 by pulleys 8a, 9a fixed to their rotatable shafts and belts 23 trained around the pulleys 8a, 9a and the pulley 22. The end surface of the engine 1 lying behind the pulleys 8a, 9a, 22 and the belts 23 across the crankshaft 21 is covered substantially entirely with an upper belt cover member 24a and a lower belt cover member 24b.

Camshafts 25a, 25b are rotatably supported in upper portions of the cylinder banks 2a, 2b, respectively. Timing pulleys 26a, 26b are fixed respectively to ends of the camshafts 25a, 25b. Another timing pulley 27 is fixed to the projecting end of the crankshaft 21 behind the pulley 22. A timing belt 30 is trained around the timing pulleys 26a 26b 27 and also around an idler pulley 28 and a tensioning pulley 29 for rotating the camshafts 25a, 25b about their own axes in timed relation to the crankshaft 21.

The timing pulley 27 on the crankshaft 21 and the timing pulleys 26a, 26b on the camshafts 25a, 25b are so sized that they relatively rotate at a speed ratio of 2/1. Therefore, while the crankshaft 21 makes two revolutions, the camshafts 25a, 25b each make one revolution.

As described above, the end surfaces $S_1$, $S_2$ of the cylinder banks 2a, 2b are offset from each other. Because the timing pulleys 26a, 26b are mounted on the camshafts 25a, 25b in a plane aligned with the end surface $S_2$ which projects beyond the end surface $S_1$, there is a clearance of $\Delta L$ created between the end surface $S_1$ and the rear surface of the timing pulley 26a.

Figure 3:
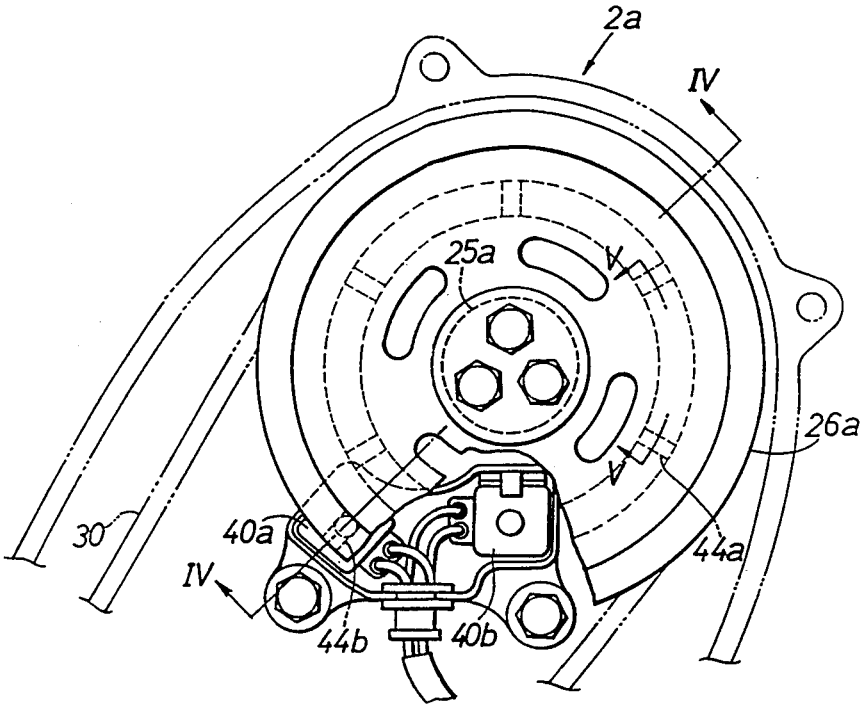
FIG. 3 is a fragmentary enlarged elevational view of a portion of the engine shown in FIG. 2.
Figure 4:
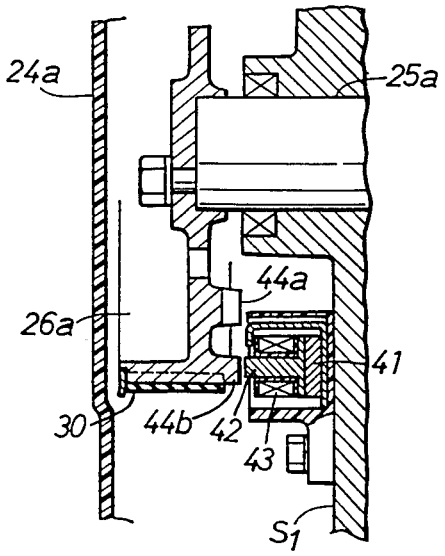
FIG. 4 is a cross-sectional view taken along line IV—IV of FIG. 3.

As shown in FIGS. 3 and 4, a pair of electromagnetic probes, i.e., a first cylinder detecting probe 40a and a top-dead-center detecting probe 40b, is mounted by bolts on the end surface $S_1$ and disposed in the clearance between the end surface $S_1$ and the timing pulley 26a. As better shown in FIG. 4, each of the probes 40a, 40b comprises a core 42 made of a magnetic material and coupled to a permanent magnet 41, and a coil 43 disposed around the core 42.

Figure 5:
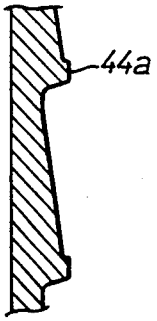
FIG. 5 is a cross-sectional view taken along line V—V of FIG. 3.

As illustrated in FIGS. 3 through 5, six top-dead-center detecting teeth 44a are formed on the rear surface of the timing pulley 26a in circumferentially equally spaced relation, and one first cylinder detecting tooth 44b is formed on the rear surface of the timing pulley 26a in a radially outward position thereon. When the tip of one of the teeth 44a, 44b is moved in proximity with the tip of the core 42, the magnetic flux produced from the permanent magnet is varied to induce an alternating current in the coil 43. The alternating current thus generated is shaped in waveform to produce a pulse signal which indicates the top-dead-center position of each cylinder or the first cylinder.

The timing pulleys 26a, 26b on the camshafts 25a, 25b are rotated clockwise (FIG. 2) about their own axes. Therefore, the tension on the righthand timing pulley 26a, is greater than the tension on the lefthand timing pulley 26b. The accuracy with which the timing pulley 26a rotates in timed relation to the crankshaft 21 is consequently higher than that with which the timing pulley 26b does. The timing pulley 26a around which the timing belt 30 subject to greater tension is trained is positioned over the end surface $S_1$ of the cylinder bank 2a which is displaced from the cylinder block end surface, and the distributor 3 is mounted on the opposite end of the camshaft 25a which is remote from the timing pulley 26a, with the torque rod 17 being coupled to the engine at the other cylinder bank 2b which is displaced in the opposite direction. With this arrangement, the generation of wasteful spaces in the engine compartment of the motor vehicle is prevented.

Figure 6:
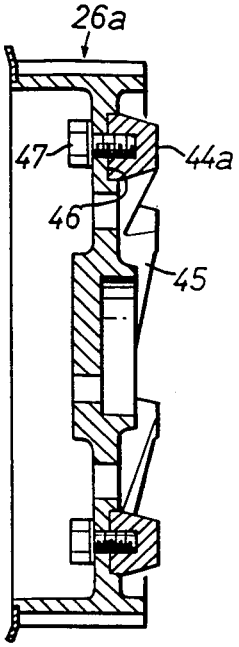
FIG. 6 is a vertical cross-sectional view of a pulley according to another embodiment of the present invention.

FIG. 6 shows another embodiment of the present invention. The top-dead-center detecting teeth 44a are formed on an end surface of a ring member 45 made of a magnetic material. The ring member 45 is partly fitted in an annular slot 46 defined in the rear surface of the timing pulley 26a and fixed to the timing pulley 26a by means of bolts 47. Thus, the detecting teeth 44a and the timing pulley 26a are firmly coupled to each other. This structure is advantageous in that since the timing pulley 26a can be formed of a light alloy, the inertial mass of the timing pulley 26a can easily be adjusted.

The present invention has been shown and described as being incorporated in a V-shaped engine. However, the principles of the present invention are not limited to the illustrated embodiment, but are equally applicable to an in-line DOHC engine or a flat opposed engine.

With the arrangement of the present invention, the rotation sensor and the distributor can be arranged out of physical interference with other accessories. Any dimensional change which may be caused by the inclusion of the rotation sensor is held to a minimum, so that the engine remains compact. The rotation sensor and the crankshaft are rotatable in phase with each other for effecting engine control highly accuragely. The rotation sensor itself is simple in construction thereby allowing the engine to be simple and compact. Inasmuch as the speed of rotation of the camshafts is half that of the crankshaft, any tolerance for unbalanced operation can be relatively large, and hence secondary problems which would arise from the use of the magnetic teeth can be avoided.

Although certain preferred embodiments have been shown and described, it should be understood that many changes and modifications may be made therein without departing from the scope of the appended claims.

We claim:

1. In a rotation sensor for an internal combustion engine having a crankshaft, a camshaft, a drive pulley on the crankshaft, a driven pulley on the camshaft, and an endless belt trained around the driver and driven pulleys, an improvement comprising, rotation sensing means on the driven pulley and engine for sensing the rotational position of the driven pulley relative to the engine during rotation of the driven pulley.

2. The rotation sensor of claim 1 wherein said rotation sensing means includes a magnetic tooth on the driven pulley and an electromagnetic probe mounted on the engine.

3. The rotation sensor of claim 2 wherein, said magnetic tooth is removably mounted on the driven pulley.

4. The rotation sensor of claim 3 wherein the driven pulley is on a light weight alloy.

5. The rotation sensor of claim 4 wherein a plurality of magnetic teeth are provided on the driven pulley.

6. The rotation sensor of claim 5 wherein at least one said magnetic tooth is positioned at a different radial distance on the driven pulley, and a second electromagnetic probe is mounted on the engine for sensing the at least one magnetic tooth during rotation of the driven pulley.

7. The rotation sensor of claim 1 wherein the endless belt is trained over another driven pulley and said rotation sensing means is provided with the driven pulley that is subjected to the greater tension on the endless belt.

8. The rotation sensor of claim 1 wherein a space is provided between the driven pulley and a front surface of the engine, and said rotation sensing means includes a sensing probe mounted in said space.

9. The rotation sensor of claim 8 wherein the engine is of a V-type with one bank of cylinders longitudinally offset from another bank of cylinders by a small distance required by offsetting the cylinders, and said space is provided by said small distance.

10. A rotation sensor in a multicylinder internal combustion engine including a camshaft, a driven pulley fixed to an end of said camshaft, a crankshaft, a driver pulley fixed to an end of said crankshaft, a single endless belt trained around said driven and driver pulleys, said rotation sensor comprising a magnetic tooth disposed on said one driven pulley and an electromagnetic probe mounted on a fixed engine member for detecting when the magnetic tooth is moved in proximity with said electromagnetic probe.

11. A rotation sensor according to claim 10, wherein said magnetic tooth is integrally formed with said one driven pulley.

12. A rotation sensor according to claim 10, wherein said magnetic tooth is mounted as a separate member on said one driven pulley.

13. A multicylinder internal combustion engine comprising:

a pair of camshafts;

a pair of driven pulleys fixed to ends of said camshafts;

a crankshaft;

a driver pulley fixed to an end of said crankshaft;

a single endless belt trained around said driven pulleys and said driver pulley; and a rotation sensor for detecting the rotation of the engine, said rotation sensor being disposed between a fixed engine member and one of said driven pulleys around which a portion of said endless belt subject to greater tension is trained.

14. A multicylinder internal combustion engine according to claim 13, further including a pair of cylinder banks arranged in a V shape with said crankshaft supported centrally therein, said cylinder banks being offset from each other in the direction of said crankshaft, said one driven pulley being disposed on the end of one of said camshafts which is rotatably supported on one of said cylinder banks that is displaced from a plan with respect to the other cylinder bank by being offset inwardly therefrom.

15. A multicylinder internal combustion engine according to claim 13, further including a distributor coupled coaxially to an opposite end of the camshaft to which said one driven pulley is fixed.

16. A multicylinder internal combustion engine according to claim 13, wherein said rotation sensor includes a magnetic tooth disposed on said one driven pulley and an electromagnetic probe mounted on said fixed engine member for detecting when the magnetic tooth is moved in proximity with said electromagnetic probe.

17. A multicylinder internal combustion engine according to claim 16, wherein said magnetic tooth is integrally formed with said one driven pulley.

18. A multicylinder internal combustion engine according to claim 16, wherein said magnetic tooth is mounted as a separate member on said one driven pulley.

* * * * *